US006409561B1

(12) United States Patent
Ibasfalean

(10) Patent No.: US 6,409,561 B1
(45) Date of Patent: Jun. 25, 2002

(54) REMOTE ACTIVATED WATER SELF RESCUE SYSTEM

(76) Inventor: John C. Ibasfalean, Rte. 4 Box 3245, Lake Butler, FL (US) 32504

( * ) Notice: Subject to any disclaimer, the term of this patent is extended or adjusted under 35 U.S.C. 154(b) by 0 days.

(21) Appl. No.: 09/675,766

(22) Filed: Sep. 29, 2000

(51) Int. Cl.[7] ..... B63C 9/04; B63C 9/19

(52) U.S. Cl. ..... 441/93; 441/41; 441/42; 441/80

(58) Field of Search ..... 441/80, 88, 89, 441/93, 41, 42, 92

(56) References Cited

U.S. PATENT DOCUMENTS

| | | | | |
|---|---|---|---|---|
| 3,175,236 A | * | 3/1965 | Bagdassarroff | |
| 4,498,879 A | * | 2/1985 | Burr | 441/80 |
| 4,702,715 A | * | 10/1987 | Winick | 441/80 |
| 5,006,831 A | | 4/1991 | de Solminihac | 340/573 |
| 5,400,922 A | * | 3/1995 | Weinheimer | 441/93 |
| 6,195,039 B1 | * | 2/2001 | Glass, Jr. | 441/89 |

FOREIGN PATENT DOCUMENTS

| | | | | |
|---|---|---|---|---|
| FR | 2 638 705 | * | 5/1990 | 441/80 |
| WO | WO 85/04144 | * | 9/1985 | 441/80 |

* cited by examiner

*Primary Examiner*—Sherman Basinger
(74) *Attorney, Agent, or Firm*—Sven W. Hanson

(57) ABSTRACT

The present invention regards personal rescue devices for use by individuals separated from watercraft in open water. Provided are an inflation valve and rescue device having high reliability and insensitivity to environmental conditions. The inflation valve includes a fusible element, such as a stainless steel wire, which is fused or broken by application of an electrical current. Prior to use, the fusible element retains a trigger in a position to prevent a penetrator from releasing compressed gas from a gas canister. Upon activation and breaking of the fusible element, the penetrator is forced into the gas canister releasing gas to inflate the rescue device. The rescue device is retained within a deployment canister having a cover that is easily sealed and resealed to ease maintenance and operation. The rescue device is incorporated into a remotely activated rescue system including a miniature radio frequency transmitter which may be worn on a user's body such as on a wrist strap. In the remote system, a receiver and power supply for deploying the rescue device is retained on a watercraft. Various other embodiments incorporate the electrically activated inflation valve with other rescue devices and in conjunction with water activated valves.

13 Claims, 6 Drawing Sheets

REMOTE ACTIVATED WATER SELF RESCUE SYSTEM

BACKGROUND OF THE INVENTION

The present invention pertains to personal rescue systems for use on watercraft. In particular, the invention pertains to automatically or remotely activated systems for deploying rescue devices into the water surrounding a watercraft.

Persons on watercraft such as commercial and pleasure ships which operate distant from shore have a continuing risk of separation from their craft. Experience has shown that it is not only in instances of extreme weather that persons are lost from ships. With any watercraft that is underway, or even simply drifting with the wind, a person falling into the water may be quickly separated from the craft. Regaining the craft and self-rescue is often impossible. In situations where persons remaining onboard observe a person overboard, manual rescue devices may be put into action. However, it is often the case that persons falling overboard, or swept overboard, are not noticed until rescue is difficult. In addition, when no additional persons remain onboard the craft, such as in situations of solo-operation of craft, typical rescue devices are of no value. To ensure rescue in all cases, a water rescue system must either be capable of automatic deployment or of remote deployment by the person in the water.

Many devices and systems have been designed for self rescue. The typical focus of these systems is deployment of a rescue device by means not requiring action of on-board personnel. In some cases a continuously available rescue device is used, such as a rescue rope towed behind a craft for persons in the water to grasp. However, in addition to being ineffective in many instances, this device potentially interferes with craft operation. Other prior devices rely on automatic sensing of persons separated from a watercraft followed by automatic deployment of rescue devices. One example of this is disclosed in U.S. Pat. No. 5,006,831 to de Solminihac which employs an acoustic signal continuously transmitted from a watercraft and through the water. Persons aboard the craft retain an alarm pack on their body including a receiver for detecting the acoustic signal when the person enters the water. The alarm pack then activates by remote control the deployment of a rescue device from the craft. However, de Solminihac does not provide a reliable means of deploying the rescue device. Unless release of a rescue device into the water can be assured, a rescue system is not effective.

As well as remote or automatic activation, it is necessary to have a highly reliable mechanism for releasing a rescue device into the water. A significant difficulty in designing, operating and maintaining rescue systems on watercraft is the inherent presence of water. The inevitable water and high humidity that surrounds the enviroment of watercraft introduces problems of degradation and consequent failure of mechanical and electrical systems. This is particularly true in saltwater which accelerates oxidation of many materials. Failure of watercraft systems due to saltwater corrosion is an ever-present problem for all watercraft operating on saltwater. This is a particular problem for safety systems such as water rescue systems which are infrequently used, but must have a low failure rate in operation. The problems of reliability is only exacerbated by the added elements found in the environment of commercial watercraft such as small commercial fishing vessels. Such craft have a highly physical environment as well as increased exposure to water due to the nature of the efforts engaged in such businesses. This is particularly relevant to the deployment elements of rescue systems which, by the nature of their operation, must be exposed and adjacent the water. For a rescue system to be reliable for such uses, it must be capable of surviving in a highly abusive environment. Also, because of the profit oriented nature of commercial businesses, rescue devices for commercial watercraft are preferably easily and cheaply maintained.

What is needed is a self-rescue system which is reliable and easily maintained. Such a system should be capable of quickly deploying a rescue device into the water surrounding a water craft upon remote activation by persons in the water and distanced from the watercraft.

SUMMARY OF THE INVENTION

The above problems are solved by a the present personal rescue system including an electrically activated inflation valve, a resealable deployment canister and a remote activation system. The inflation valve includes a fusible element that retains the inflation valve in a ready condition prior to use. Breaking of the fusible element activates the inflation valve. In one embodiment, the fusible element encircles a number of resilient fingers that retain a spring-loaded plunger. Upon application of an electric current through the fusible element, the fusible element fuses or breaks allowing the resilient fingers to be pushed from the plunger. The plunger strikes a pointed penetrator that is driven through a gas canister seal, thereby releasing compressed gas. The fusible element is formed of corrosion resistant materials such as stainless steel wire.

To simplify maintenance and testing of the rescue system, a deployment canister is used to house and protect the rescue device. The deployment canister includes a cover which is sealed to the canister by a seal element which is compressed and captured between the canister internal wall and the cover perimeter edge. The seal forms a barrier to the external environment and can accommodate large ranges of temperatures. The cover may be easily manually removed for maintenance. In operation, a rescue device within:the sealed deployment canister is inflated to a size to force the cover from the canister. The rescue device then exits the deployment canister and falls or is projected into the water adjacent the deployment canister.

A remote activation system allows for a rescue device to be deployed by an individual separated from a watercraft without assistance of other persons. A miniature radio frequency transmitter is sized to be worn on the body of the user. Upon the user being separated from the user's watercraft, the transmitter is manually activated. The transmitted signal is received by a radio frequency receiver located on the watercraft. The receiver directs an electrical current through a circuit to a deployment canister positioned at a point on the watercraft adjacent the water. The electric current activates an inflation valve, thereby releasing a rescue device into the water. In this way, a rescue device may be quickly released without aid of other persons.

The deployment canister and inflation valve are also combined with other rescue devices and with previously known water-activated inflation valves. In one alternative embodiment, the inflation valve is used to inflate a deployment pillow within a deployment canister. The inflating deployment pillow ejects an inflatable rescue device from the deployment canister. Upon contact with the water, the rescue device is inflated automatically through activation of a water activated valve.

Other benefits of the present invention will become clear from the following details of exemplary embodiments and associated figures.

DESCRIPTION OF THE PREFERRED EMBODIMENTS

Figure 1:
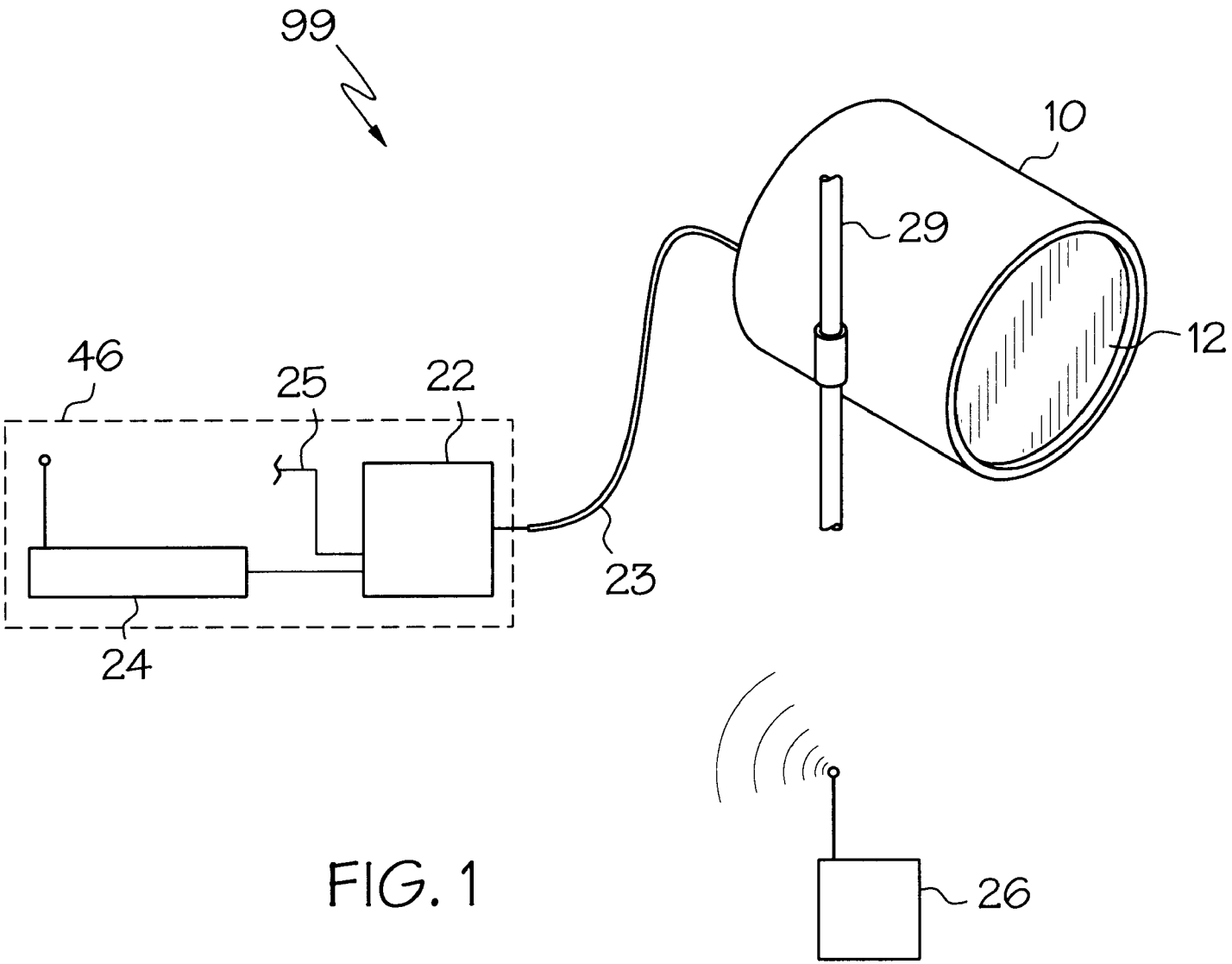
FIG. 1 depicts one embodiment of the invention including a deployment canister and secured to a watercraft stanchion.

FIGS. 1, 2, 3A and 3B illustrate one embodiment of a remote rescue system according to the present invention. A self-rescue system 99 includes a hollow deployment canister 10. Prior to deployment, an inflatable rescue device 14 is retained in a deflated condition within a cavity 16 of the deployment canister 10. A compressed gas canister 18 and inflation valve 20 are also provided within the cavity 16 as a means of inflating the rescue device. Upon activation of the inflation valve 20, compressed gas within the gas canister 18 is released, through a passage into the rescue device 14 to inflate it. The gas canister 18 and inflation valve 20 are secured to the rescue device 14. The inflation valve 20 is configured to be electrically activated by an impulse from a power supply 22 through a power circuit 23. A radio frequency receiver 24 is connected to the power supply 22. The receiver 24 is configured to receive, and respond to, signals transmitted from a remote transmitter 26. The receiver 24, power supply 22, and deployment canister 10 are mounted on a watercraft. The deployment canister 10 is mounted in a position and orientation such as to present the cavity opening at the edge of the watercraft and toward the open water surrounding the watercraft. The deployment canister in the figures is shown secured to a stanchion 29 such as often found at the edge of the deck of sailing and power ships. Until deployment, the canister 10 is closed by a cover 12 positioned in the mouth of the canister cavity The cover 12 is retained in position by a circular seal ring 30 (FIG. 3) which is located and captured between the deployment canister and the perimeter edge of the cover 12.

In operation, the remote transmitter 26 is carried or secured to a person onboard a watercraft. The receiver is continuously operational to receive a predetermined signal. In the event that the person is separated from the watercraft, the person activates the transmitter 26 to send the predetermined radio frequency signal. Upon receiving the radio frequency signal from the remote transmitter 26, the receiver 24 directs the power supply 22 to send a electrical impulse to the inflation valve 20, activating it to inflate the rescue device 14. The rescue device 14 inflates, expanding within the cavity 16 until the pressure of the rescue device 14 on the cover 12 drives the cover 12 past the seal ring 30 and out of the cavity opening. The rescue device is sized such that, fully inflated, its volume is significantly greater than the cavity volume. Due to its larger size, inflation of the rescue device 14 causes it to be projected from the cavity 16 and fall into the water. A portion of the power circuit 23 within the cavity includes a easily separable electrical connection 34. The weight of the rescue device 14 as it falls (FIG. 2) from the deployment canister 10 separates the connection 34 and frees the rescue device 14 from the deployment canister. The person in the water approaches the rescue device and uses it to remain afloat until rescue.

Figure 2:
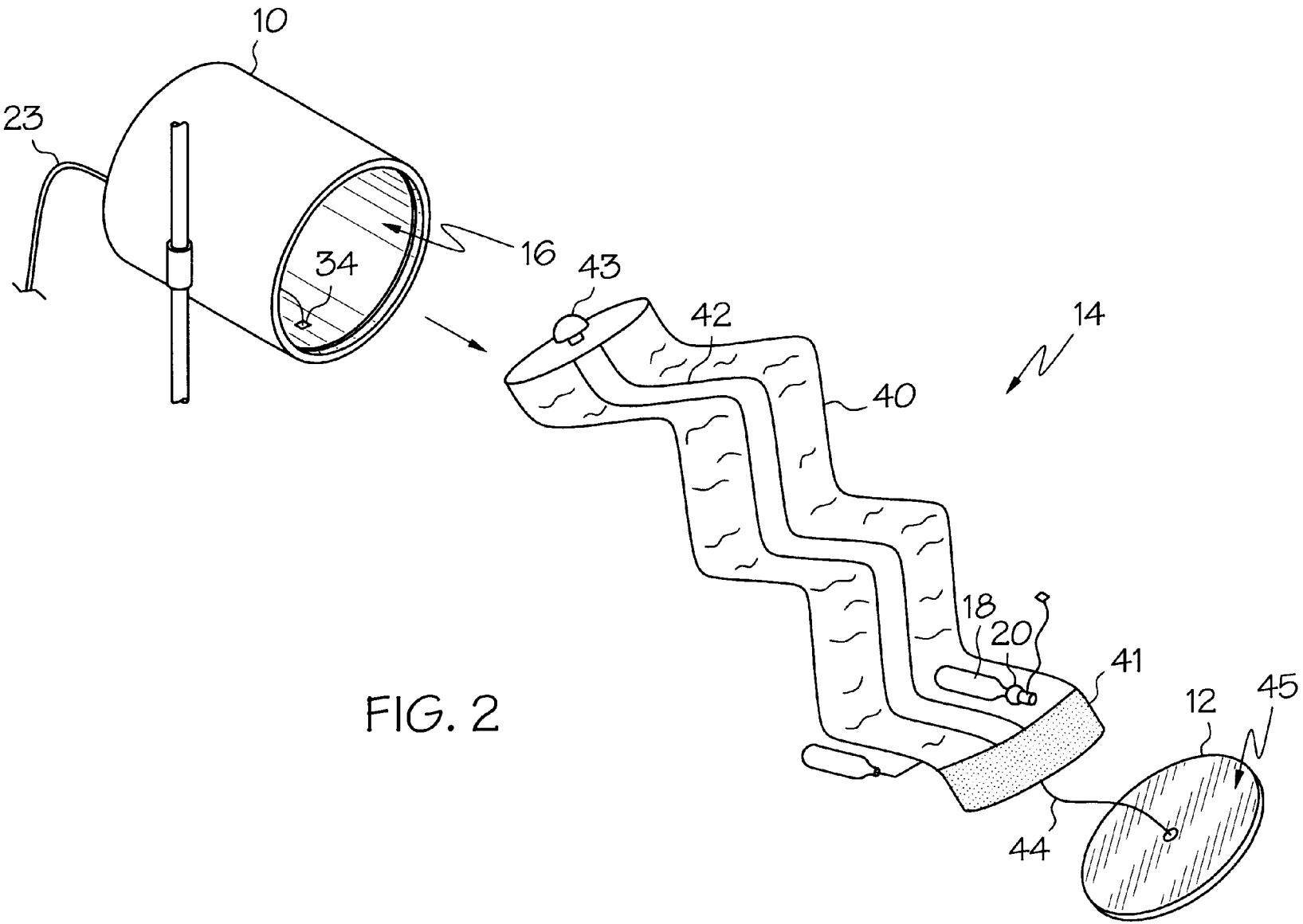
FIG. 2 depicts the deployment of a rescue device from the embodiment shown in FIG. 1.

The rescue device has different configurations including inflatable devices previously known. In FIG. 2, a preferred rescue device 14 is shown which has an elongated inflated body 40 having an integral weighted end portion 41. The weighted end functions to right the rescue device in the water such that a portion of the elongated inflated body 40 projects above the level of the water. The total buoyancy of the rescue device is preferably sufficient to retain at least one person above the water. The rescue device may also be large enough to accommodate two or more persons. Buoyancy guidelines for such purposes are provided by the U. S. Coast Guard and other government agencies. A reflective edge portion 42 and a powered light beacon 43 increase visibility of the rescue device. Other desired elements include manual inflation devices and straps or harnesses to secure the person to the rescue device. In FIG. 2, the deployment canister cover 12 is shown attached to the rescue device 14 by a tether 44. The cover has highly reflective side surface 45 so that the cover 12 may be used manually to signal searching parties by reflecting sunlight. In alternative embodiments, the rescue device may take on other shapes and sizes including an inflatable raft large enough to allow persons to enter.

The transmitter 26 and receiver 24 must be operable at sufficient range such that a person separated from a moving watercraft has adequate time to recover from submersion and activate the transmitter. Preferably the operable range of these devices is at least 700 feet (213 meters). This is based on a calculated separation distance between a stationary person in the water and a craft moving away at a speed of 25 miles per hour. However, due to the limited ability of persons to reach a distant rescue device in the open water, it is desirable that the rescue device be deployed at much shorter distances. Preferably the transmitter is sufficiently small to make it convenient to carry continuously on a person's body. At the same time, the transmitter must be waterproof and not susceptible to damage from ocean environment. The receiver 24 should also be waterproof or located in a waterproof barrier 46 on the watercraft. A self rescue system according to the present invention may be made using commercially available transmitters and receivers. A prototype transmitter was made by providing a waterproof plastic case in which was secured a radio transmitter distributed by the Auto-Tronics Security Company (Part No. 90-982) with a receiver for use as a remote automobile engine starter. An effective range of at over 700 feet can be obtained with this device. Similar miniature transmitters and receivers are commercially available for a variety of purposes. This example transmitter is sufficiently small that the case may be secured to a wrist strap and worn on a person's wrist in the position of a typical wristwatch. A benefit of this method and configuration is the ease and quickness with which the transmitter may be accessed and activated. Such a transmitter attached to the wrist may be quickly raised above the water surface and activated by a person in the water. Quick activation, after separation of the person from a moving watercraft, reduces the separation distance between the person and a deployed rescue device, increasing the chance of recovery and rescue. Due to the nature of radio propagation, such devices must be held above the water's surface to effectively transmit. A transmitter secured to the wrist enables such operation. In alternative embodiments, the transmitter includes a water-activated switch, various types of which are commercially available. The advantage of an automatically activated transmitter is the ability to operate in situationswhere the person to whom it is secured is incapacitated. However, automatic transmitters are problematic in the necessity of ensuring their position above the water. This may be accomplished by use of an integral self-righting buoyant element.

In FIG. 1, the receiver 24 and power supply 22 are shown as two distinct elements. In alternative embodiments, the function of these two elements are integrated into a single unit. The power supply 22 may include batteries for activation of the inflation valve 20 or may obtain power from a connected independent power source such as a watercraft's main batteries, generator, or other electrical power source. The power supply 22 preferably includes one or more switching circuits 25 which may be connected to alarms and engine cutoff switches. This enables these functions to be automatically activated in the event that a signal is received and a rescue device is deployed. Other rescue systems and safety systems may also be activated in this way. The particular design of the power supply 22, power circuit 23, switching circuits 25 and associated electrical devices will be obvious to those skilled in such systems.

Figure 3B:
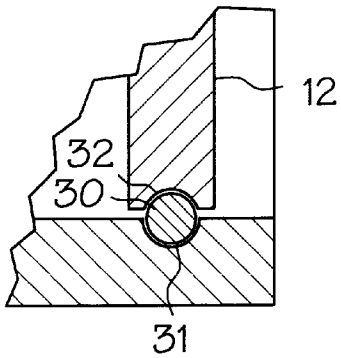
FIGS. 3A and 3B are cross section views of a deployment canister including a contained collapsed inflatable rescue device.
Figure 3A:
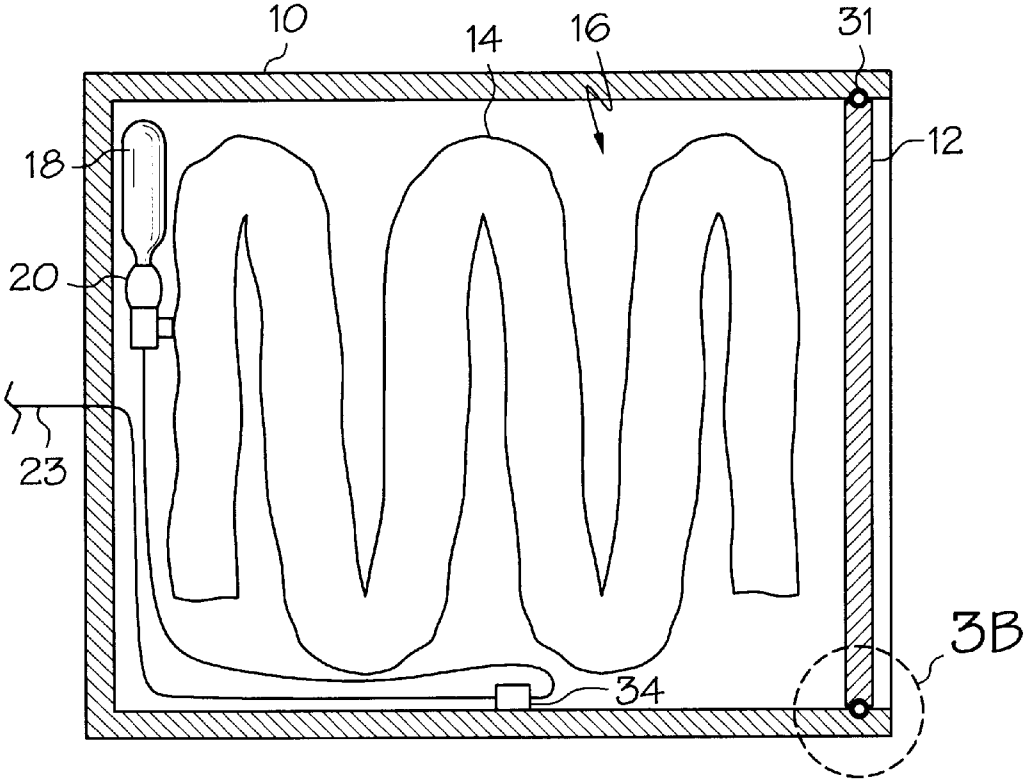

FIGS. 3A and 3B shows the rescue device 14 in a deflated condition in a deployment canister 10. For clarity, some of the elements shown in FIGS. 1 and 2 (ie. beacon, etc.) are not shown in FIGS. 3A and 3B. Also, the rescue device is shown more loosely fitting within the canister cavity 16 than is desired. The relative size and volume of the cavity and the inflated rescue device must be such that upon being inflated, the rescue device is pushed substantially out of the cavity. If the rescue device is too small relative to the cavity it is possible that the cover will be pushed from the canister, but the rescue device remain within the cavity. Preferably also, the rescue device is elongated in one dimension and has an elongated length significantly greater than the depth of the cavity. With these characteristics, the rescue device will be assured of being projected from the cavity during inflation. Folding and placement of the rescue device within the cavity such as to present heavier elements adjacent the cover will also assist in removing the rescue device from the canister upon deployment. A successful prototype system of the present invention included a deployment canister having a cavity volume of 309 inches$^3$ (5070 cm$^3$) versus a rescue device inflated volume of approximately 600 inches$^3$ (9800 cm$^3$). The deployment canister cavity depth was 5.9 inches (15 cm) versus an inflated rescue device length of approximately 53 inches (135 cm). This is a volume ratio of almost 2 to 1 and a length ratio of approximately 9 to 1. At this configuration, the prototype rescue device was consistently projected out of, and away from, the deployment canister. The deployment canister and cover of the prototype system were fabricated from polyvinylchloride (PVC). Although PVC is a preferred material due to its insensivity to salt and water and its toughness, alternative materials include, but are not limited to, polymers and metals typically used in structures for use in marine environments.

Because the deployment canister cover 12 is sealed to the canister, force must be exerted on the inside face of the cover to remove it from the deployment canister 10. This force is generated by the pressure generated by the gas released by the compressed gas canister 18. The required pressure is dependent on the manner in which the cover is attached and sealed to the canister. At the same time, the speed at which pressure is developed within the rescue device is also important to successful deployment of a rescue device. Inflation of the rescue device should occur sufficiently quickly that the cover is not just removed but is projected away from the canister. The rescue device preferably inflates sufficiently quickly that it is thrust with some velocity out of the canister. In the above discussed prototype, the cover was removable at an internal pressure of 3 to 5 PSIG (pounds per square inch, gauge). The rescue device was inflated in less than one second using a standard compressed gas canister providing 23 grams of carbon dioxide gas, producing a velocity which projected the cover and rescue device about three feet from the canister upon deployment. This projection of the rescue device is beneficial in clearing possible obstructions which may be present on a watercraft surrounding the deployment canister. The requirements of the compressed gas canister, in terms of volume, pressure and speed are dependent upon the particular dimensions and geometry of the canister, cover, and rescue device. Proper function of a device is easily verified by trial and error, the critical performance characteristic being that the rescue device leave the deployment canister quickly upon activation to ensure its entry into the water.

Due to the nature of the environment surrounding most watercraft—continuous moisture and potentially salt exposure—it is desirable to isolate the rescue device and inflation means from the outside elements. The cover 12 should be sealed to the deployment canister 10 in a manner to ensure that salt and water vapor cannot enter the canister. At the same time, the cover 12 must be reliably removable from the deployment canister 10 by application of a predetermined force. Preferably, the cover is also easily removed and replaced manually by the user for maintenance and testing. This reduces operational costs. In the present invention, the cover is sealed to the canister by an intervening elastomeric O-ring type of seal ring 30 which resides between grooves in the cover 12 and deployment canister 10 as shown in FIGS. 3*a* and 3B. The inside cylindrical wall of the deployment canister has a first circumferential groove 31 which mates with a second groove 32 on the circumferential edge of the cover 12. When the cover 12 is in place such that these grooves 31,32 are aligned, a somewhat circular space is formed in which sits a seal ring 30. The seal ring 30 is sized slightly larger than the circular space such that an interference and compression of the seal ring result which retains the cover in place. The interference is slight enough that the seal ring 30 may be placed on the cover 12 and the cover forced into the cavity, compressing the seal ring, until the seal ring is seated in both grooves and the cover is in place. The compression of the seal ring acts both as a seal isolating the cavity and contents and as a retainer of the cover. Because the seal ring 30 provides a seal between the cover 12 and deployment canister 10, the cover is not required to be tight fitting in the cavity mouth. Rather, it is desirable that the cover be sufficiently smaller than the cavity that quick and reliable removal upon deployment is ensured. A tight or snug fitting cover may potentially jam and prevent successful operation. An additional advantage of the present inventive deployment system is accommodation of large changes in temperature. Due to temperature changes and temperature gradients, which may be experience by craft in many regions, the fit of the cover may change within the deployment canister. A noncompliant or close tolerance seal, unlike the present invention, may be rendered ineffective by these dimensional changes. However, the present configuration using elastomeric o-rings provide a potentially large tolerance to dimensional changes. By designing the o-ring compression to accommodate thermal dimensional effects, successful operation in a wide range of conditions can be assured. It has also been found desirable to form the cover perimeter groove deeper than the groove in the canister to ensure that the seal ring is always retained in the cover when the cover is removed from the canister. Various cross-sectional geometries of seal ring and grooves are possible to produce the required seal and, with the above description, construction of effective seals will be obvious to those skilled in the art. The seal ring should be formed of a material which is not degraded by salt or moisture and is durable. Acceptable materials are those known for producing similar such seals. A particular benefit of this cover and seal design in combination with the inflation valve discussed herein is the ease with which the system may be repacked after use, maintenance, or in case of accidental activation. After inflation and deployment of the rescue device, the rescue device may be deflated and connected to a new inflation valve and gas canister. The new inflation valve is then connected to the power circuit and the rescue device replaced in the proper orientation in the deployment canister. The original cover and seal ring may be easily replaced and reused. This may be accomplished by the user with the deployment canister in place on the associated water craft. The only cost of reuse is a replacement cost of a new inflation valve.

Figure 4:
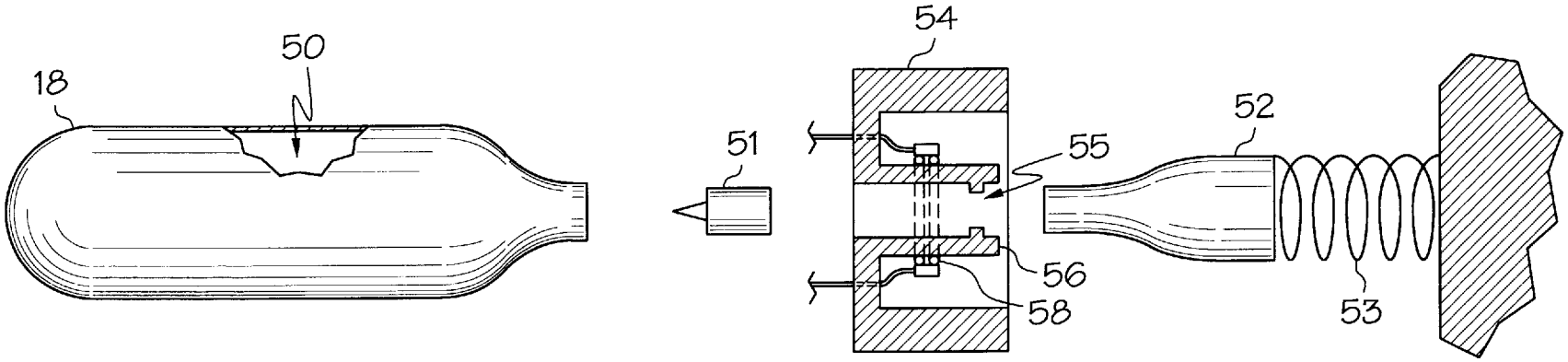
FIG. 4 depicts an inflation valve according to the present invention.
Figure 5B:
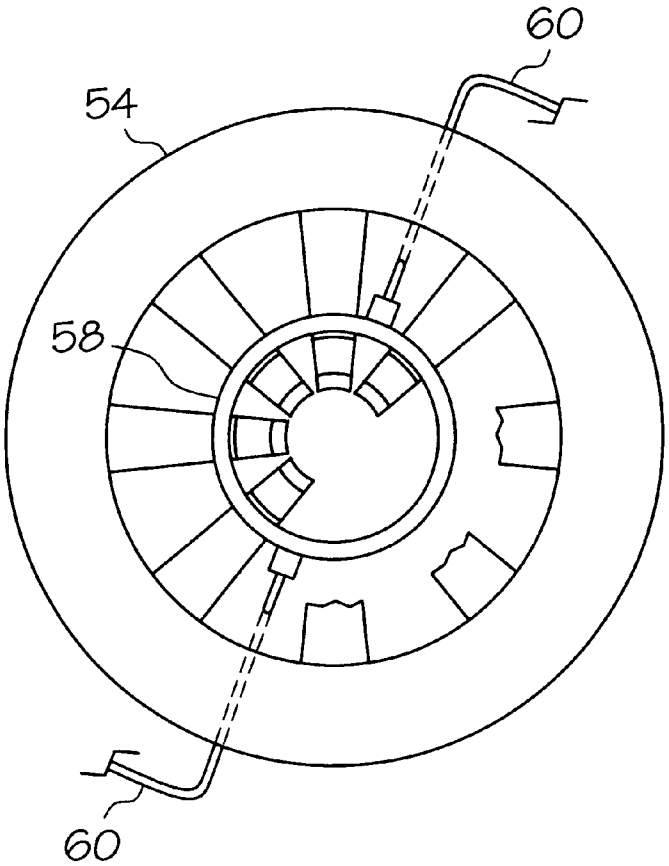
FIGS. 5A and 5B depict a sectional view and axial view, respectively, of the inflation valve trigger shown in FIG. 4.
Figure 5A:
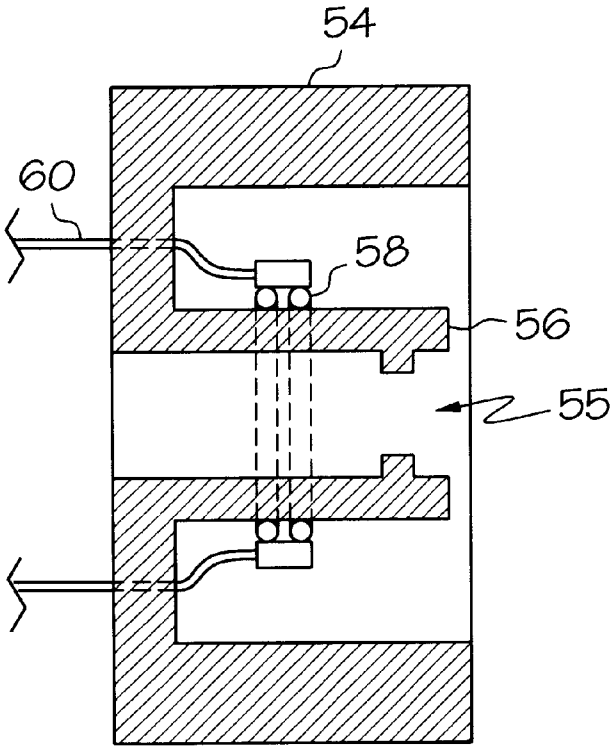

FIG. 4 depicts a compressed gas canister 18 with an exploded view of an inflation valve according to one embodiment of the invention. The gas canister 18 contains compressed gas 50 which is released when a penetrator 51 having a point is forced into a neck of the gas canister 18 creating an opening in a canister seal. The penetrator is forced into the gas canister by a plunger 52 driven by a spring 53. Prior to use, the plunger is distanced from the penetrator by an intervening trigger 54. The trigger 54 releasably retains the plunger 52 until an activating event releases the plunger 52 to strike the penetrator 51. FIG. 5A and 5B depict two views of the trigger 54 and illustrates its operation. The trigger 54 has an axial opening 55 surrounded by a number of resilient fingers 56. In FIG. 5B three of the resilient fingers 56 are partially cut away to clarify the view of the assembly. In a first nonoperative condition the fingers 56 grasp the end of the plunger 52 preventing its passage through the opening 55. Due to the pressure of the spring 53 on the plunger, the fingers 56 are pressed radially outward. To retain this condition, a fusible band 58 encircles the fingers 56 and prevents their outward displacement. In this condition, the inflation valve 20 is maintained in readiness for use. When inflation of a rescue device is desired, the band 58 is broken allowing the fingers to move radially outward and away from the plunger 52. The plunger 52, thereby released, passes through the opening 55 and strikes the penetrator 51 to penetrate and open the gas canister 18.

In the embodiment shown, the band 58 consists of two circles of stainless steel wire. These are connected, at diametrically opposite positions, to an electrical circuit 60 such as the power circuit discussed above. The connection may be made by soldering, welding, or other known methods of completing electrical connections. The wires of the power circuit pass through a gap between adjacent fingers and exit any valve housing that might be employed. By applying sufficient current through the electrical circuit 60 and band 58, the band 58 is quickly fused and broken. The band 58 must have sufficient strength and stiffness to retain the fingers 56 in place. At the same time, the band 58 must be easily and certainly broken with a minimal current when activation is desired. Copper or other high conductivity metals, as typically used in conductors, are not preferred in forming bands due to their low resistance and hence the increased current required to fuse and break them. For safety and cost reasons, minimizing the current required for fusing the band is desired. Preferably, the band 58 is formed of materials having both relatively high strength and low conductivity such as the stainless steels. Stainless steels have additional benefit in being relatively unaffected by water and salt environments. This results in higher reliability. In a prototype device of this embodiment, the band 58 was formed of two circles of stainless steel wire, each having a diameter of 0.012 inch (0.30 mm). An applied electrical current of about five to ten (5 to 10) amperes through the band resulted in instantaneously breaking both wire circles with no detectable electrical heating of the device. Experiments showed high repeatability of this configuration and operation.

A prior inflation valve is available from the Halkey-Roberts Corporation in St. Petersburg, Fla., USA as product V85000 Series Inflator. In a prototype of the above embodiment, the gas canister 18, penetrator 51, plunger 52, spring 53 and trigger are essentially identical to the Halkey-Roberts device. However, the V85000 Inflator does not use a fusible band to retain and release trigger elements. Like several other similar prior devices of this kind, the V85000 device retains trigger fingers by surrounding them with a compressed water-activated powder which is captured in solid form in a annular space in a trigger body. In those devices, the fingers are released when the powder contacts water causing the powder to lose its solid structure. However, the reliability of such triggers is low due to the unavoidable presence of water in the air surrounding a typical installation of these devices, causing unintended and uncontrolled activation of these valves. Rescue devices which rely on water activation alone are not preferred. The present device operates irrespective of the presence of environmental water or moisture or lack thereof In alternative embodiments of the present invention, the band 58 is formed of a single or multiple encircling elements of various cross section. Although stainless steel is a preferred material as discussed above, other materials having the required properties or otherwise performing in like manner are contemplated.

Figure 6:
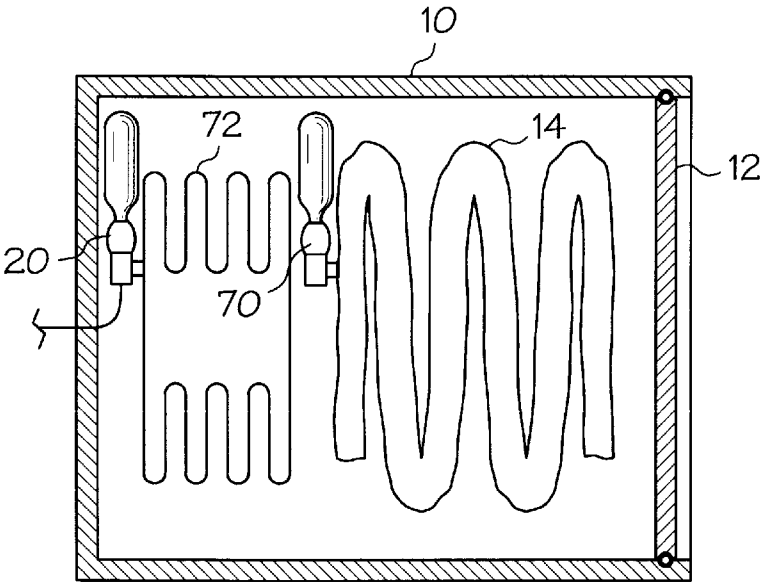
FIG. 6 depicts an alternative embodiment of the invention in which a separate inflatable deployment pillow is used to push a rescue device from a deployment canister.

FIG. 6 depicts an alternative embodiment of the invention in which a rescue device 14 is combined with a water-activated inflation valve 70 and compressed gas canister 18 such as is currently commercially available. The V85000 valve above is one example of such valve. The rescue device 14 is packed in a deployment canister together with a separate inflatable deployment pillow 72. This pillow 72 is configured and connected in the same manner as the rescue device discussed with respect to FIG. 3. Upon activation, the electrically operated inflation valve 20 inflates the pillow 72 which pushed the deflated rescue device 14 and cover 12 from the deployment canister 10 and into the water. The rescue device is then inflated by the water activated inflation valve 70 and connected gas canister. The construction and operation of the canister cover 12 and seal ring 30 is the same as in the previous embodiment.

Figure 7:
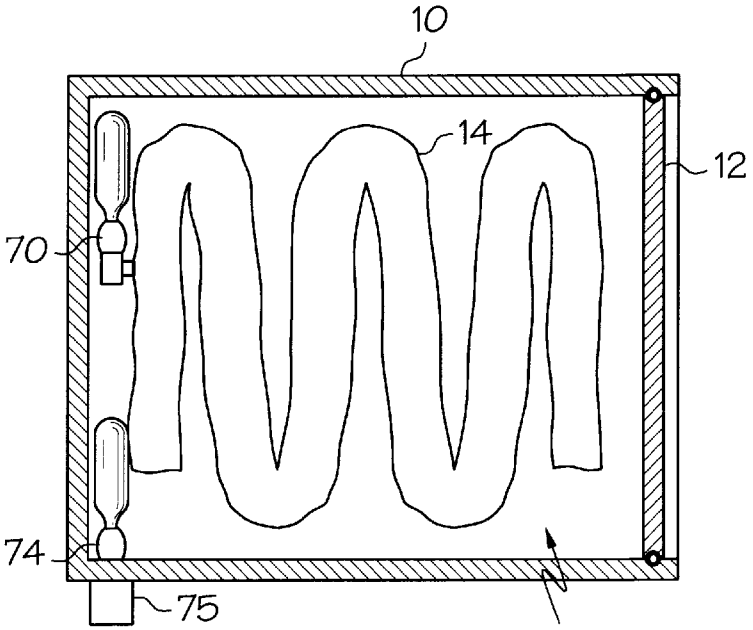
FIG. 7 depicts a cross section of an alternative embodiment of the invention including a water activated inflation device.

FIG. 7 depicts another alternative embodiment of the invention in which a deployment canister cover 12 is blown off of a deployment canister 10 by internal pressure. A rescue device 14 and water activated inflation valve 70 are as described with respect to the embodiment of FIG. 6 above. A second fixed water activated inflation valve 74 and compressed gas canister 18 is connected to the deployment canister so as to vent compressed gas from the gas canister 18 to the deployment canister cavity 10. This pressurizes the cavity sufficient to force the cover 12 from the deployment canister 10. The rescue device 14 is, at the same time, released with the expanding gas. Upon entering the water the rescue device 14 is inflated by the water activated valve 70. The fixed valve 74 passes through a hole in the deployment canister 10 and has a water activated trigger which is retained within an enclosure 75 on the outside of the canister 10. The enclosure protects the trigger but allows water to contact the trigger only on conditions when the enclosure 75 is submerged for a period of time. This type of valve and enclosure is currently available from the Halkay-Roberts company referenced above. This configuration gains unique benefits from combination of these prior valves in operation with the deployment canister 10 and cover 12 of the present invention. Although not gaining the additional benefits of the electrically activated inflation valve of the prior embodiments, this configuration provides a rescue system operable in conditions when the associated water craft is submerged or has foundered such that electrically activated systems are ineffective. This rescue device will be deployed from a fully submerged watercraft and is contemplated as a secondary or backup rescue system.

Other alternative embodiments utilizing the present deployment canister, cover and deployment method with prior inflation valves alone, or in combination with the present novel inflation valve, are contemplated. For example the present electrically activated inflation valve may be used to pressurize a deployment canister in the manner of the embodiment shown in FIG. 7, releasing a rescue device having a water activated valve. Combination of the present valve with other inflatable rescue devices is also contemplated. The present valve's benefits of insensitivity to the environment and high reliability are gained also when used without the deployment canister discussed above.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

I claim:

1. A watercraft personal rescue device ensuring reliable deployment comprising:

an inflatable body;

a compressed gas canister containing compressed gas, the gas canister connected to the inflatable body such that gas released from the canister enters the inflatable body;

a plunger biased toward the canister in a first condition;

a penetrator between the plunger and canister a trigger body restraining the plunger in the first condition, the trigger body comprising a plurality of resilient retaining elements encircling the plunger and biased outward by the plunger; and a fuse maintaining the trigger body in the first condition, the fuse comprising at least one metal filament encircling the retaining elements, the fuse separable by passage of electrical current through the fuse;

such that, upon the fuse separating, the trigger moves into a second condition allowing the plunger to force the penetrator into the canister to release compressed gas to the inflatable body.

2. The device according to claim 1, wherein:

the metal filament comprises stainless steel wire having a diameter of 0.012 inches.

3. A watercraft personal rescue device ensuring reliable deployment comprising:

an inflatable body;

a compressed gas canister containing compressed gas and connected to the inflatable body;

an inflation valve for releasing compressed gas from the gas canister to the inflatable body, the valve having a fuse comprising a fusible material;

means of applying an electrical current through the fuse such that the inflation valve is activated upon applying an electrical current through the fuse; and a deployment canister having a cavity;

the inflatable body and inflation valve removably retained within the cavity;

a deployment canister cover; the cover removably sealing the cavity;

and wherein:

the inflatable body is of sufficient size and the compressed gas canister contains sufficient gas such that activation of the inflation valve causes the inflatable body to be inflated, thereby forcing the cover from the deployment canister and allowing the inflatable body to exit from the canister.

4. The device according to claim 3, wherein:

the cavity has a depth, and the inflatable body has a length greater than the cavity depth.

5. The device according to claim 4, wherein:

the inflation valve is capable of releasing gas to the inflatable body such that the inflatable body is projected from the deployment canister.

6. The device according to claim 3, wherein:

the deployment canister has a cavity opening, the opening having a first circumferential groove;

the cover disposed in the cavity opening and having a second circumferential groove, and a seal element is compressed between the first and second circumferential groove thereby removably retaining the cover in the cavity opening.

7. The device according to claim 3, further comprising:

a signaling device for initiating, from a location remote from the deployment canister, the application of electrical current.

8. A watercraft personal rescue system comprising:

a deployment canister having a cavity;

an inflatable rescue device and a compressed gas canister retained within the cavity;

a deployment canister cover; the cover removably sealing the cavity;

an inflation valve for releasing gas from the compressed gas canister to the rescue device, the inflation valve having a fuse separable by application of an electrical current through the fuse; separation of the fuse initiating the inflation valve to release gas; and a remote activation system for activating the inflation valve from a location distant from the deployment canister, the remote activation system capable of applying an electric current through the fuse;

such that upon application of electrical current through the fuse, the inflation valve releases compressed gas to the rescue device causing it to inflate and remove the cover from the deployment canister.

9. The system according to claim 8, wherein:

the remote activation system comprises:

a radio frequency transmitter, and a radio frequency receiver capable of receiving a signal from the transmitter, and an electrical power supply for applying an electrical current to the fuse upon receiving a signal.

10. The system according to claim 9, wherein:

the transmitter is configured to be worn on a person's wrist.

11. An inflatable watercraft rescue device ensuring reliable inflation comprising:

a deployment canister having a cavity;

a canister cover; the cover removably sealing the cavity;

an inflatable rescue device;

a first compressed gas canister and a first inflation valve, both connected to the rescue device, the first inflation valve capable, upon contact with water, of inflating the rescue device;

an inflatable deployment pillow retained in the deployment canister cavity;

a second compressed gas canister and second inflation valve for inflating the deployment pillow, the second inflation valve having a fusible element for activating the second inflation valve upon application of an electrical current through the fusible element; and the rescue device disposed in the cavity substantially between the deployment pillow and the cover;

such that upon application of an electrical current through the fusible element the second inflation valve inflates the deployment pillow to push the cover and rescue device from the deployment canister.

12. In a rescue device inflation valve having a penetrator for opening a compressed gas canister to allow release of compressed gas into an inflatable rescue, the improvement comprising:

a plunger for causing the penetrator to penetrate the gas canister;

a plurality of resilient retaining elements encircling the plunger;

a fusible element encircling the retaining elements and which is separable upon application of an electrical current through the fusible element; such that separation of the fusible element causes the penetrator to penetrate the gas canister.

13. The inflation valve of claim 12, wherein:

the fusible element is a circle of stainless steel wire.

* * * * *